United States Patent [19]

Iwasaki

[11] Patent Number: 4,895,683

[45] Date of Patent: Jan. 23, 1990

[54] APPARATUS FOR MASS TRANSFERRING BETWEEN PHASES DIFFERENT FROM EACH OTHER

[75] Inventor: Yoshihiko Iwasaki, Miyazaki, Japan

[73] Assignee: Kiyomoto Tekko Kabushiki Kaisha, Miyazaki, Japan

[21] Appl. No.: 301,237

[22] Filed: Jan. 24, 1989

Related U.S. Application Data

[62] Division of Ser. No. 43,221, Apr. 27, 1987, Pat. No. 4,818,447.

[51] Int. Cl.[4] ..... B01F 3/04

[52] U.S. Cl. ..... 261/104; 210/321.78; 210/321.80; 261/DIG. 75

[58] Field of Search ..... 261/104, DIG. 75, DIG. 28; 210/321.78, 321.80

[56] References Cited

U.S. PATENT DOCUMENTS

| | | | |
|---|---|---|---|
| 1,817,987 | 8/1931 | Kerr | 285/356 |
| 2,000,653 | 5/1935 | Wilkinson | 285/356 |
| 2,437,632 | 3/1948 | Wolfram | 285/356 |
| 2,958,548 | 11/1960 | De Vienne et al. | 285/356 |
| 3,228,876 | 1/1966 | Mahon | 261/104 |
| 3,430,990 | 3/1969 | Nelson | 285/356 |
| 3,545,731 | 12/1970 | McManus | 261/122 |
| 3,711,072 | 1/1973 | Waldenville | 261/122 |
| 3,768,977 | 10/1973 | Brumfield et al. | 261/122 |
| 3,922,220 | 11/1975 | Middleman et al. | 210/321.78 |
| 4,098,852 | 7/1978 | Christen et al. | 261/104 |
| 4,331,540 | 5/1982 | Witsoe | 210/321.78 |
| 4,355,636 | 10/1982 | Oetjen et al. | 261/104 |
| 4,360,234 | 11/1982 | Hsueh et al. | 261/122 |
| 4,583,969 | 4/1986 | Mortensen | 261/122 |
| 4,621,843 | 11/1986 | Straub | 285/356 |
| 4,647,380 | 3/1987 | Dasgupta | 210/321.78 |
| 4,744,900 | 5/1988 | Bratt | 210/321.78 |

FOREIGN PATENT DOCUMENTS

| | | | |
|---|---|---|---|
| 965375 | 2/1950 | France | 261/122 |
| 140334 | 8/1982 | Japan . | |
| 694918 | 7/1953 | United Kingdom | 261/122 |

*Primary Examiner*—Tim Miles

*Attorney, Agent, or Firm*—Scully, Scott, Murphy & Presser

[57] ABSTRACT

According to the present invention, in an apparatus for mass transferring between phases different from each other, tube plates are fixed to opposite opening ends of an outer tubular column having a fluid feeding nozzle and a fluid discharge nozzle, the tube plates are each formed therethrough with a through-hole for fixing a porous tube, the hole is formed over the entire peripheral wall thereof with a stepped portion such that an elastic member such as an O-ring can be easily provided. A tubular press-in member including an annular elastic member, a collar and the like are provided in the hole, into which the end portion of the porous tube is coupled, whereby the press-in member is pressed into a space formed between the hole wall and the porous tube wall so as to achieve sealing between the porous tube wall and the tube plate wall, so that the inner porous tube can be replaced by a new one simply, easily and quickly.

2 Claims, 3 Drawing Sheets

APPARATUS FOR MASS TRANSFERRING BETWEEN PHASES DIFFERENT FROM EACH OTHER

This is a divisional of copending application Ser. No. 043,221, filed on Apr. 27, 1987, now U.S. Pat. No. 4,818,447.

BACKGROUND OF THE INVENTION

This invention relates to an apparatus for mass transferring between phases different from each other, and more particularly to an apparatus for mass transferring between phases different from each other, such as a gas-liquid contact apparatus or a liquid-liquid contact apparatus, which has porous contact walls, between a gaseous phase and a liquid phase or between liquids insoluble with each other, i.e. between phases different from each other. Furthermore, this invention relates to a separation apparatus having porous walls, which is used for separating an emulsive content from emulsion such as oil and water, concentrating a solution or the like, extracting a solvent content in liquid, absorbing gas and the like.

There has heretofore been a practice wherein an inner tube provided on a tubular wall thereof with micro-pores and an outer tube constitute a double wall tube, liquid is introduced into the inner tube and gas is introduced to the outside of the inner tube, and part of gas is dissolved into the liquid in the inner tube through micro-pores formed in the tubular wall, to thereby obtain liquid dissolved therein with the gas. In the above-described apparatus using the porous inner tube, in order to provide and fix the porous tubular member or members into the outer tube, the porous tubular member or members are fixed to fixing flanges by use of an adhesive or the like.

However, in the above-described apparatus, an inner and an outer fluidic chambers of the double wall tube are mounted in sealed states, respectively, and the inner and outer tubular members should be easily replaceable. Hence, according to the aforesaid conventional mounting and fixing method, it is disadvantageous in that it is impossible to remove, replace the porous tubular member or members, and so forth, and further, impossible to replace the porous tubular member or members with new ones due to clogging and remount the porous tubular member or members after reproduction such as acid washing, heating and the like. Furthermore, it is disadvantageous in that stresses cannot be absorbed for fixing the adhesive, there is a possibility of damaged porous tubular member or members due to a difference in thermal expansion (between the porous tubular member or members and the fixing flanges) when heating fluid is caused to flow, and similarly, there is a possibility of damaged porous tubular member or members due to fluidic pressure or vibrations of the fixing flanges.

This invention contemplates to obviate the disadvantages in fixing of the porous tubular member or members as seen in the aforesaid conventional apparatus.

SUMMARY OF THE INVENTION

The present invention has as its object the provision of an apparatus for sealingly fixing tubular members, wherein an inner porous tubular member or members and an outer tubular member can be easily and quickly replaced, and moreover, reliably mounted in sealed states.

More specifically, the present invention features an apparatus for contact between phases different from each other, comprising:

an outer tubular column formed at side wall portions thereof with a nozzle for feeding fluid and a nozzle for discharging fluid, and formed at opposite ends thereof with openings, respectively;

tube fixing members fixed to the openings formed at the opposite ends of the outer tubular column and each having a through-hole formed on an inner wall surface thereof with an annular stepped portion;

a porous tubular member or members each having opposite ends thereof inserted through the through-holes of the tube fixing plates;

an elastic member positioned at a shoulder of the inner wall of each annular stepped portions of the through-holes between the porous tubular member or members and the inner walls of the through-holes; and a tubular press-in member coupled into each of the spaces formed between the porous tubular member or members and the inner walls of the through-holes, and each having a length capable of pressing in the elastic member at the forwa rd end thereof.

According to the present invention, the outer tubular column is provided at suitable positions thereof with openings of the feeding and discharging nozzles so that the fluid can flow through the outer tubular column. Fixing of the tube fixing members to the outer tubular column is performed by use of threadable coupling, flange securing, adhesive attaching and the like, for example, so that the tube fixing plates can be detachably or undetachably, firmly fixed to the outer tubular column in liquid tight and air-tight states.

According to the present invention, in order to slightly movably support the porous tubular member or members in the axial direction thereof with the air tightness being held, elastic members such as O-rings, packings and the like are pressed against the porous tubular member or members. As these elastic members, it suffices to use such ones which can be elastically deformed by being pressed and is highly corrosion-resistant.

Furthermore, according to the present invention, in order to satisfactorily secure the pressing force of the elastic members, annular stepped portions are formed on the inner wall surfaces of the through-holes for supporting the porous tubular member or members, which are provided on the tube fixing plate. As a consequence, according to the present invention, the outer diameter of the hole formed in the tube fixing plate is made large as compared with the inner diameter thereof. As described above, according to the present invention, the outer diameter of the hole formed in the tub fixing plate is made larger than the inner diameter thereof, whereby a space formed between the inner wall of the hole formed in the tube fixing plate and the outer wall of the porous tubular member is made large, so that the length of the tubular member of the pressor to press the elastic member can be secured, and further, the thickness of the tubular member of the pressor can be made satisfactorily large.

The pressors for the elastic members can be integrally fixed to the tube fixing plate. However, it is preferable to detachably fix because replacement of the elastic member can be facilitated. In this case, the well known fixing means such as threadable coupling and bayonet fixing may be adopted.

The present invention is of such an arrangement that the stepped portions are formed on the inner wall surfaces of the through-holes, the elastic members such as the O-rings are provided on these stepped portions, these elastic members are pressed by the pressors, and these elastic members are closely attached to the porous tubular members, to thereby hold the porous tubular members, so that a plurality of porous tubular members can be held in tight states, and moreover, stresses generated by heat, vibrations and the like can be absorbed, to thereby hold the porous tubular members without being damaged. As a consequence, the present invention is advantageous in that the apparatus can be formed compact in size as compared with the conventional apparatus for mass transferring between phases different from each other, such as contact between phases different from each other, has an outstanding treating capacity, replacement and repair of the porous tubular member or members can be made simple and easy, and the degree of damage of the porous tubular members can be reduced.

According to the present invention, it is preferable to use the porous tubular members having a mean diameter of about 10 μm or less, and more preferable to use the porous tubular members having a mean diameter of about 0.1–10 μm.

By forming the porous tubular members from Shirasu Porous Glass (S.P.G.) in particular, the apparatus for mass transferring between phases different from each other, in using a concentrator, a mass exchanger between gas-liquid phases, a chemical purifying apparatus, an oil-water separating apparatus and the like, makes the functions thereof efficiently performed.

BRIEF DESCRIPTION OF THE DRAWINGS

The modes of working of the present invention will hereunder be described with reference to the accompanying drawings. It should be understood, however, that the invention is not limited by the description and examples shown.

DETAILED DESCRIPTION OF THE PREFERRED EMBODIMENTS

Figure 1:
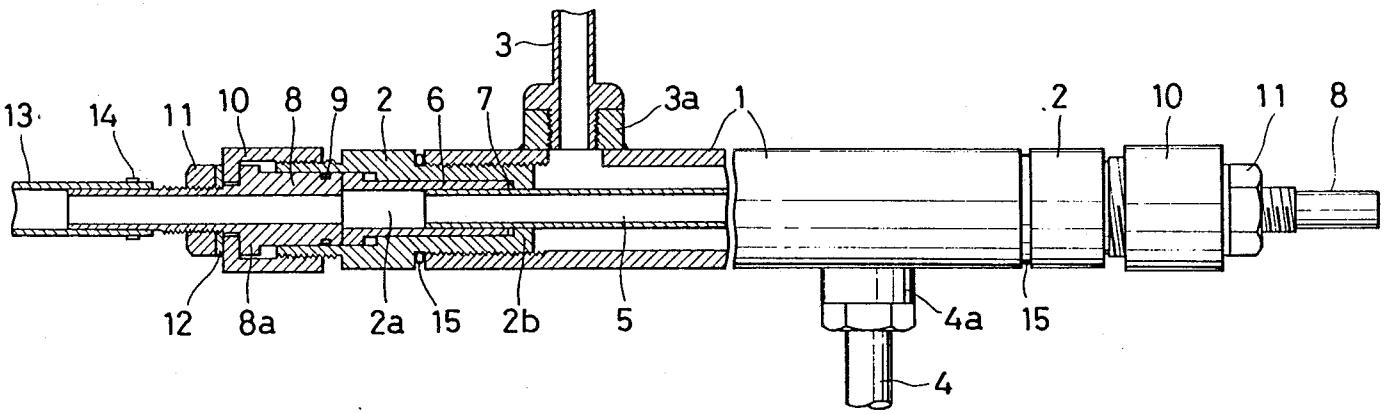
FIG. 1 is a sectional view showing one embodiment of the present invention.

In FIG. 1, designated at 1 is an outer column, made of an acryl resin material, having an outer diameter of about 30 mm and a wall thickness of about 5 mm for example, and threadably coupled to opposite end openings thereof with tube fixing members or fixing flanges 2, respectively. A feeding nozzle 3 for feeding fluid such as air is attachedly provided on the top of one side of the outer tubular column 1, and a discharging nozzle 4 for discharging the fluid is attachedly provided on the bottom of the other side of the outer tubular column 1.

Denoted at 3*a* and 4*a* are packings for the above-described nozzles 3 and 4.

Each of the fixing flanges 2 is formed therein with a circular opening 2*a*, into which a porous tubular member 5 is inserted.

The porous tubular member 5 is formed of a cylindrical Shirasu Porous Glass (S.P.G.) having an outer diameter of 13.7 mm and a wall thickness of 1.8 mm for example.

This porous tubular member will hereunder be described in more detail. The material of the porous tubular member 5, which has been developed by Tadao NAKAJIMA, Takashi SHIMIZU and Mikio KOHNO, members of the Industrial Laboratory of Miyagi-ken, Japan is a so-called "Shirasu Porous Glass" (S.P.G.) having a multiplicity of micro-pores (0.1–10 μm in mean diameter and 50% or more in porosity) obtained by heat-treating and acid-treating glass of $CaO.B_2O_3$-$SiO_2$-$Al_2O_3$ which is synthesized by adding lime and boric acid to a main raw material formed from volcanic ashes "Shirasu" abundantly deposited all over the southern "Kyushu" area of Japan. The manufacturing method is disclosed in Japanese Patent Kokai (Laid-Open) No. 140334/82. The properties thereof include rigidity, heat resistance and water resistance, and wide application relating to the apparatus according to the present invention include a filter, a fluid circulator-concentrator, a liquid-gas exchanger, a heat exchanger and chemical purifiers for various chemicals, for example. A tubular press-in member or a collar 6 is inserted into a space formed between the inner wall of the opening 2*a* of the fixing flange 2 and the porous tubular member 5. An O-ring 7 is coupled into a space formed between an annular stepped portion or an annular ridge 2*b* protruded inwardly at one end of the opening 2*a* and the collar 6.

Furthermore, a nozzle 8 is inserted into the fixing flange 2 and abutted at the forward end portion thereof against the rear end portion of the collar 6 through an O-ring 9.

The nozzle 8 is formed thereon with a stepped portion 8*a*, and a cap 10 is coupled onto the fixing flange 2 in a state of being engaged with the stepped portion 8*a*.

Furthermore, a nut 11 is coupled onto the nozzle 8 and pressed against the cap 10 with a packing 12 being clamped therebetween.

Desiganted at 13 is a water feed tube connected to the nozzle 8 by a clamping device 14.

Denoted at 15 is an O-ring for sealing.

This embodiment is of the above-described arrangement, whereby, when the cap 10 is rotated in a direction of clamping relative to the fixing flange 2, the nozzle 8 is pushed into the fixing flane 2 through the stepped portion 8*a*.

When pushed in, the nozzle 8 presses the O-ring 9, whereby the O-ring is pressed out to be closely attached to the inner surface of the fixing flange 2, to thereby seal the fixing flange 2.

Further, as the nozzle 8 is pressed in, the collar 6 is pressed in as well, whereby the elastic member or the O-ring 7 between the annular ridge 2*b* and the collar 6 is pressed. The O-ring 7 thus pressed is pushed inwardly to be closely attached to the outer surface of the porous tubular member 5, to thereby fixingly seal the porous tubular member 5.

As a consequence, when air is fed through the feeding nozzle 3 of the outer tubular column 1 and cold water is fed through the water feed tube 13 and introduced into the porous tubular member 5, part of air flows into the porous tubular member 5 through micro-pores (e.g. 0.1–10 μm) of the porous tubular member 5 and is mixed with cold water.

Figure 2:
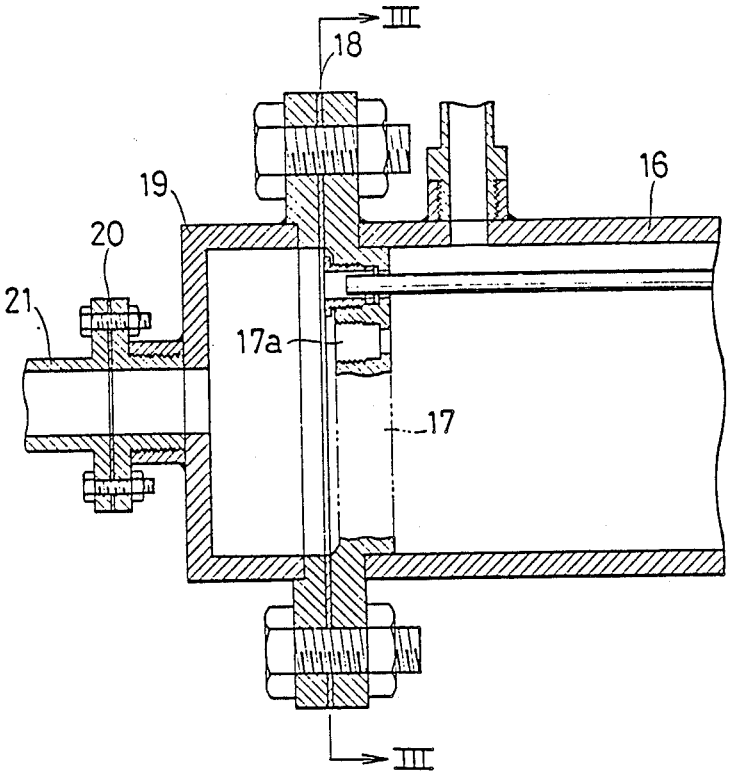
FIG. 2 is a sectional view showing another embodiment of the present invention.
Figure 3:
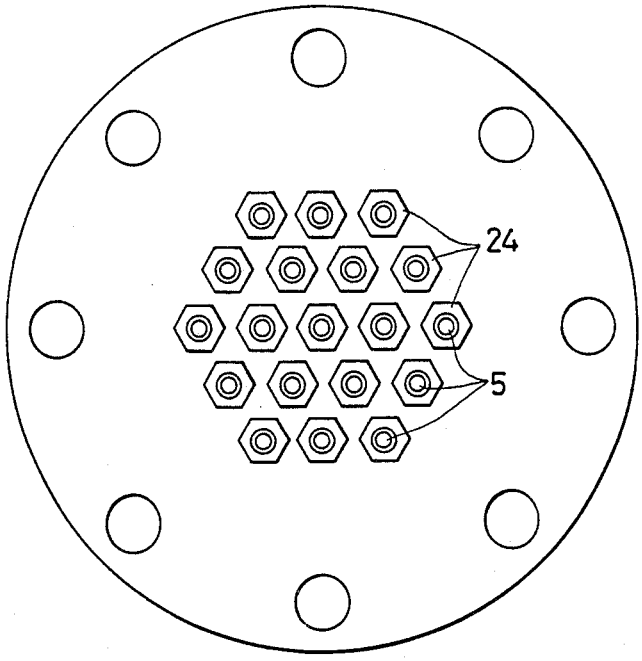
FIG. 3 is a sectional view taken along the line III—III in FIG. 2.

FIGS. 2 and 3 show a further embodiment in which a plurality of porous tubular members 5 are provided in the outer tubular column. For example, an end portion of an outer tubular column 16 of a large diameter, having an outer diameter of 150 mm and a wall thickness of 10 mm is integrally secured to a tube fiximg member or a fixing flange 17. The fixing flange 17 is secured thereto with a cover 19 through a packing 18. The cover 19 is further secured thereto with a water feed tube 21 through a packing 20.

As apparent from FIG. 3, a multiplicity of openings 17*a* are formed in the fixing flange 17.

Figure 4:
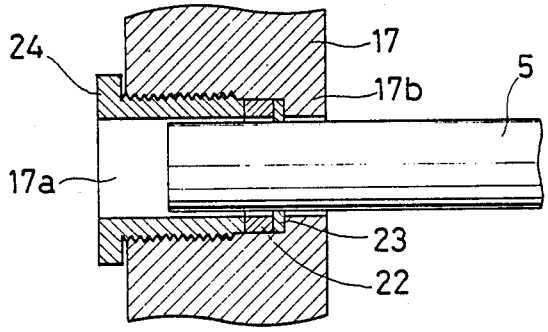
FIG. 4 is an enlarged sectional view showing the essential portions of FIG. 2.

As one of the openings 17*a* is enlarged shown in FIG. 4, the porous tubular member 5 is inserted through the opening 17*a*. A collar 22 is inserted into a space formed between the inner wall of the opening 17*a* and the porous tubular member 5. An elastic member or an O-ring 23 is coupled into a space formed between an annular stepped portion or an annular ridge 17*b* protruded at an end portion of the opening 17*a* and the collar 22.

Formed on the inner wall surface of the opening 17*a* are internal threads, to which is coupled a tubular press-in member or a fixing metal 24, the forward end face of which is abutted against the collar 22.

The tubular press-in member 24 comprises a cap which is threaded into the tube-fixing member 17.

This embodiment is of the above-described arrangement, whereby, when the fixing metal 24 is rotated in a direction of clamping, the collar 22 is pushed into the O-ring 23. The O-ring 23 thus pressed is pushed inwardly to be closely attached to the outer surface of the porous tubular member 5, to thereby fixingly seal the porous tubular member 5.

In all of the above embodiments, air is introduced into the outer tubular column and cold water is introduced into the porous tubular member or members, however, on the contrary, cold water may be introduced into the outer tubular column and air may be introduced into the porous tubular member or members.

What is claimed is:

1. An apparatus for contact between phases different from each other, comprising:

an outer tubular column formed at side wall portions thereof with a nozzle for feeding fluid and a nozzle for discharging fluid, and formed at opposite ends thereof with openings, on the inner surfaces of which are formed threads:

two fixing flange tubes each having a first end portion formed on an outer wall surface thereof with threads and at inside of an inner wall surface with an annularly raised stepped portion, a second end portion formed thinner in wall thickness than the first end portion and formed on an outer wall surface thereof with threads, and a central portion formed with a stepped portion, said threads on the outer surface of the first end portion being detachably, threadably coupled to said threads on the inner surface of either one of the openings of said outer tubular column;

a box nut-shaped cap 10 detachably, threadably coupled to the threads on the outer wall surface of the second end portion of said fixing flange tube;

a porous tube whose opposite end portions are inserted into openings of the first end portions of said fixing flange tube;

an annular elastic member provided at the stepped portion in the first end portion of said fixing flange tube and deformable under pressure;

a collar having one end portion being in contact with said annular elastic member in the first end portion of said fixing flange tube and the other end portion formed on the outer periphery thereof with a flange portion which is located at a position closer to the second end portion than the central stepped portion of said fixing flange tube;

a nozzle 8 having a first end portion capable of being in contact with the flange portion of said collar in the inner side of the second end portion of said fixing flange tube, a second end portion formed into a nozzle shape smaller in outside diameter than the first end portion, an intermediate portion formed on the outer periphery thereof with a flange portion engageable with the inner side of said cap, and a portion closer to the second end portion than said flange portion, being formed on the outer periphery thereof with threads; and a nut detachably, threadably coupled to the threads on the outer periphery of said nozzle; wherein, in a state where said cap is threadably coupled to the threads of said fixing flange tube, through said nozzle and said collar, said annular elastic member is deformed to thereby contact and hold said porous tube.

2. An apparatus for contact between phases different from each other as set forth in claim 1, wherein the mean diameter of said porous tubular members is 0.1–10 μm.

* * * * *